US009751024B2

(12) United States Patent
Morita et al.

(10) Patent No.: US 9,751,024 B2
(45) Date of Patent: Sep. 5, 2017

(54) BALLOON

(71) Applicant: TAKARA KOSAN CO., LTD., Tokyo (JP)

(72) Inventors: Takemi Morita, Fujisawa (JP); Mitsunori Yoshida, Yokohama (JP); Akira Nakamura, Yamato (JP); Satoru Taniguchi, Yokohama (JP)

(73) Assignee: Takara Kosan Co., Ltd. (JP)

( * ) Notice: Subject to any disclaimer, the term of this patent is extended or adjusted under 35 U.S.C. 154(b) by 0 days.

(21) Appl. No.: 14/895,627

(22) PCT Filed: Feb. 9, 2015

(86) PCT No.: PCT/JP2015/053486

§ 371 (c)(1),
(2) Date: Dec. 3, 2015

(87) PCT Pub. No.: WO2016/009664

PCT Pub. Date: Jan. 21, 2016

(65) Prior Publication Data

US 2016/0228784 A1 Aug. 11, 2016

(30) Foreign Application Priority Data

Jul. 17, 2014 (JP) ..... 2014-146655

(51) Int. Cl.
*A63H 27/10* (2006.01)
*A63H 3/06* (2006.01)

(52) U.S. Cl.
CPC ..... *A63H 27/10* (2013.01); *A63H 3/06* (2013.01); *A63H 2027/1025* (2013.01); *A63H 2027/1075* (2013.01)

(58) Field of Classification Search
CPC .. A63H 3/06; A63H 27/10; A63H 2027/1025; A63H 2027/1041;
(Continued)

(56) References Cited

U.S. PATENT DOCUMENTS 2,838,872 A * 6/1958 Beck ..... A63H 3/06 446/226
4,905,332 A * 3/1990 Wang ..... A47C 1/146 297/380

(Continued)

FOREIGN PATENT DOCUMENTS

CN 202199114 U 4/2012
JP S56059091 U 5/1981

(Continued)

OTHER PUBLICATIONS

Extended European Search Report for Patent Application No. EP15797239.9 dated Jun. 7, 2016 (7 pages).

*Primary Examiner* — Gene Kim
*Assistant Examiner* — Alyssa Hylinski
(74) *Attorney, Agent, or Firm* — Harness, Dickey & Pierce, P.L.C.

(57) ABSTRACT

A balloon can maintain a bent state even if a bent state-holding member is not used. A balloon includes two plastic films that are stacked and sealed at a peripheral edge. The balloon includes a first part, a second part, and a bending part that is situated between the first part and the second part. The bending part includes a gas passage through which the interior of the first part and the interior of the second part communicate with each other, and a bending sealed part that is formed by sealing the two plastic films situated opposite to each other in an inward area relative to the peripheral edge. An outer edge of the bending sealed part extends beyond the bending part so as to be situated within the first part and the second part.

11 Claims, 11 Drawing Sheets

(58) Field of Classification Search
CPC .... A63H 2027/1075; A63H 2027/1083; B65D 81/052
See application file for complete search history.

(56) References Cited

U.S. PATENT DOCUMENTS 4,936,804 A * 6/1990 Dowdeswell ..... B63C 9/135 441/122
5,023,118 A 6/1991 Cheng
5,480,029 A * 1/1996 Batsford ..... B65D 81/052 206/522
5,620,096 A * 4/1997 Pozzo ..... B65D 81/052 206/450
5,862,914 A * 1/1999 Farison ..... B65D 81/052 206/522
6,106,349 A * 8/2000 Motosko ..... B63C 9/08 441/129
6,398,029 B1 * 6/2002 Farison ..... B65D 81/052 206/522
6,554,669 B1 * 4/2003 Motosko ..... B63C 9/155 441/108
6,575,805 B1 * 6/2003 Ansolabehere ..... A63H 27/10 40/214
2007/0051656 A1 * 3/2007 Hsin ..... F16F 9/0418 206/522
2007/0161322 A1 * 7/2007 Carmon ..... A63H 27/10 446/220

FOREIGN PATENT DOCUMENTS

JP S56061291 U 5/1981
JP H04032796 U 3/1992
JP 2001087564 A 4/2001
JP 3162512 U 9/2010
JP 3169041 U * 7/2011 ..... A63H 27/10
JP 3169041 U 7/2011
WO WO-01-70593 A1 9/2001

* cited by examiner

FIG.5
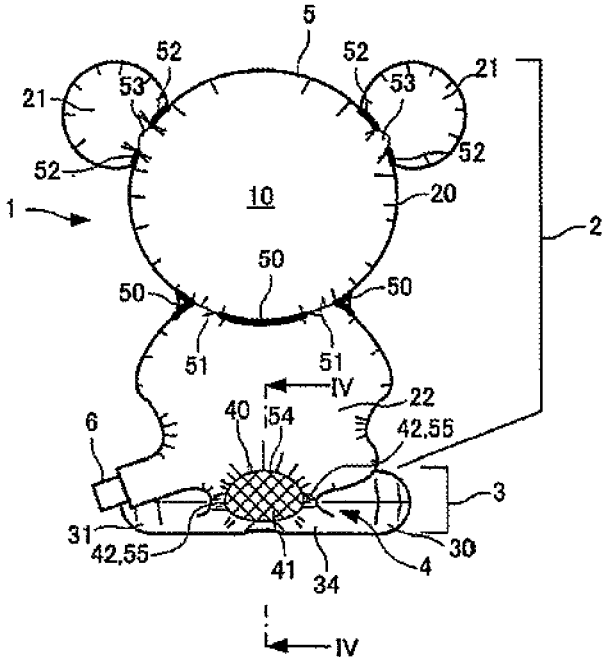
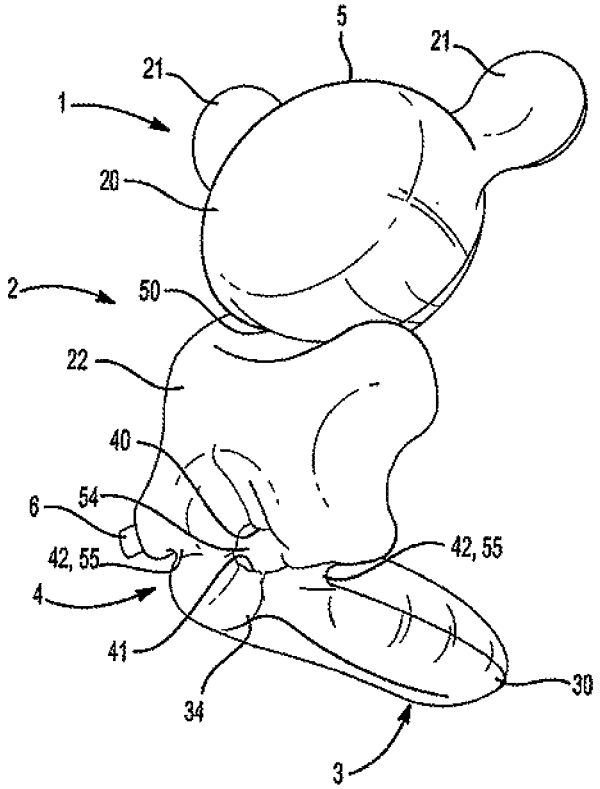
FIG. 6

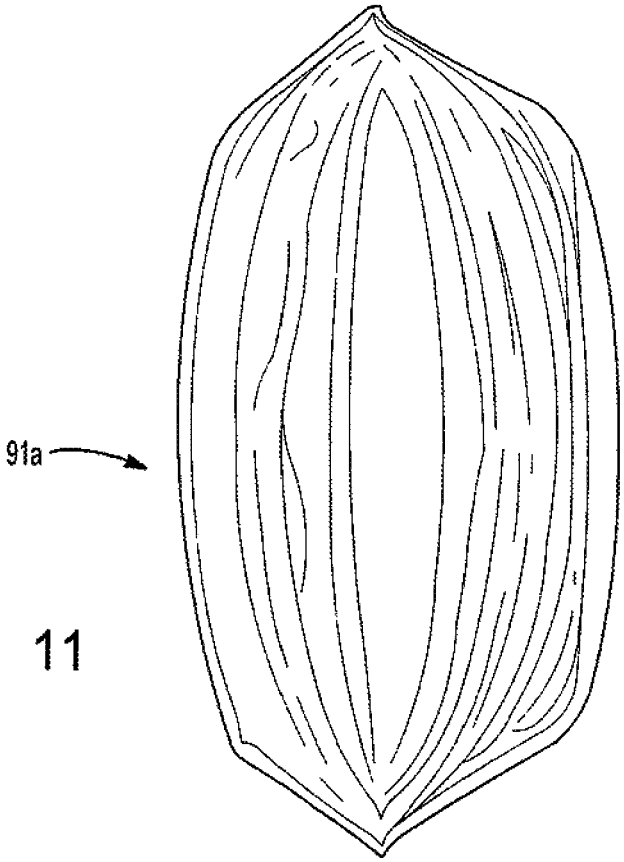
FIG. 11
FIG.12
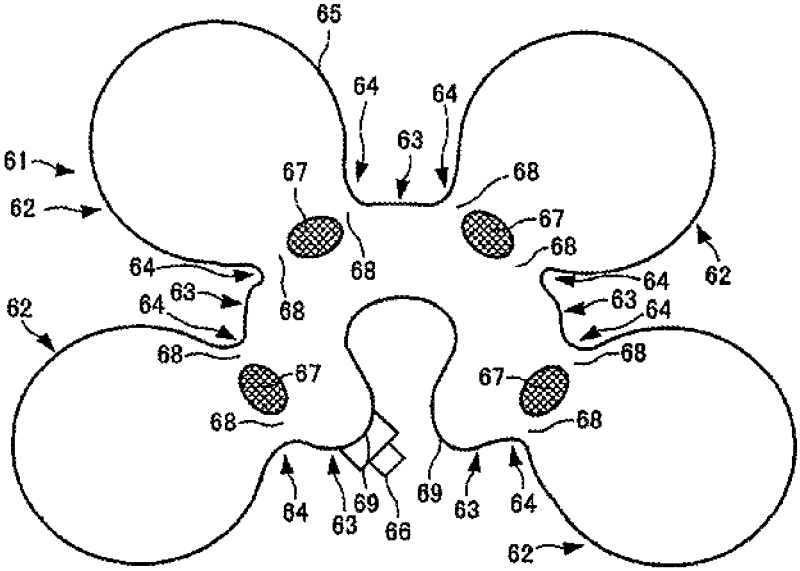

BALLOON

CROSS-REFERENCE TO RELATED APPLICATIONS

This application is a U.S. National Phase Application under 35 U.S.C. 371 of International Application No. PCT/JP2015/053486, filed Feb. 9, 2015. This application claims priority to Japanese Patent Application 2014-146655, filed on Jul. 17, 2014. The entire disclosures of the above applications are incorporated herein by reference.

TECHNICAL FIELD

The present invention relates to a balloon that can maintain a bent state even when the balloon is filled with a gas.

BACKGROUND ART

A clinging (embraceable) doll-type balloon toy that is fitted to a human arm or the like is known. For example, when such a balloon is designed to imitate an animal (animal doll) or a character (character doll), the face of the animal or the character faces forward when the balloon is fitted to a human arm or the like. A film material that forms a front member (front part), a film material that forms a rear member (rear part), and a film material that forms a bottom member (bottom part) are required so that the body of the balloon forms a right angle with a clinging member that is fitted to a human arm or the like.

In recent years, a film balloon that is formed by sealing two plastic films has been developed, and a clinging doll-type balloon toy that is formed by sealing two plastic films has been proposed (see Japanese Utility Model Registration No. 3169041, for example). Since such a clinging doll-type balloon toy can be easily produced as compared with a clinging doll-type balloon toy that is produced by combining three films in a complex manner, such a clinging doll-type balloon toy can be mass-produced. However, since such a clinging doll-type balloon toy is produced using two plastic films, it is necessary to bend the clinging doll-type balloon toy so that the body of the balloon forms a right angle with the clinging member, and provide a special bent state-holding member (double-sided pressure-sensitive adhesive tape) that maintains the bent state.

SUMMARY OF INVENTION

Technical Problem

An object of the invention is to provide a balloon that can maintain a bent state even if a bent state-holding member (double-sided pressure-sensitive adhesive tape) is not used.

Solution to Problem

The invention was conceived in order to solve at least some of the above problems, and may be implemented as described below (see the following aspects and application examples).

According to one aspect of the invention, a balloon (1) includes two plastic films (10, 12) that are stacked and sealed at a peripheral edge (5), the balloon (1) including a first part (2), a second part (3), and a bending part (4) that is situated between the first part (2) and the second part (3), the bending part (4) including a gas passage (55) through which the interior of the first part (2) and the interior of the second part (3) communicate with each other, and a bending sealed part (54) that is formed by sealing the two plastic films (10, 12) situated opposite to each other in an inward area relative to the peripheral edge (5), and an outer edge (40) of the bending sealed part (54) extending beyond the bending part (4) so as to be situated within the first part (2) and the second part (3).

In the balloon (1), the outer edge (40) of the bending sealed part (54) may be arched from the bending part (4) toward at least one of the first part (2) and the second part (3).

In the balloon (1), at least one pair of the gas passages (55) may be provided on either side of the bending sealed part (54) in the widthwise direction of the bending part (4).

In the balloon (1), a plurality of the bending sealed parts (54) may be formed along the widthwise direction of the bending part (4).

In the balloon (1), the bending part (4) may bend due to tension applied to the bending sealed part (54) by filling the balloon with a gas and inflating the balloon so that the second part (3) may be turned relative to the first part (2).

In the balloon (1), the first part (2) may be a body of a doll, and the second part (3) may be a clinging part by which the balloon is fitted to a human arm or the like.

In the balloon (1), the clinging part may include two arms (30, 31), end parts (32, 33) of the two arms, and a connection part (34) that connects base ends of the two arms (30, 31), and form an approximately ring-like shape when the balloon (1) is filled with a gas and inflated, and the connection part (34) may include a protrusion (35) that protrudes into the inner space defined by the approximately ring-like shape at a position opposite to the bending part (4).

Advantageous Effects of the Invention

The balloon according to the invention that is produced by sealing two plastic films can thus maintain a bent state in a state in which the balloon is filled with a gas.

BRIEF DESCRIPTION OF DRAWINGS

FIG. 5 is a front view illustrating a balloon in an inflated state in which a second part is turned according to the first embodiment.

FIG. 6 is a view of a balloon from an oblique lower-right front side (first embodiment).

FIG. 11 is a view of a balloon in Comparative Example 2 from the front side.

FIG. 12 is a front view illustrating a balloon according to the third embodiment.

DESCRIPTION OF EMBODIMENTS

Figure 1:
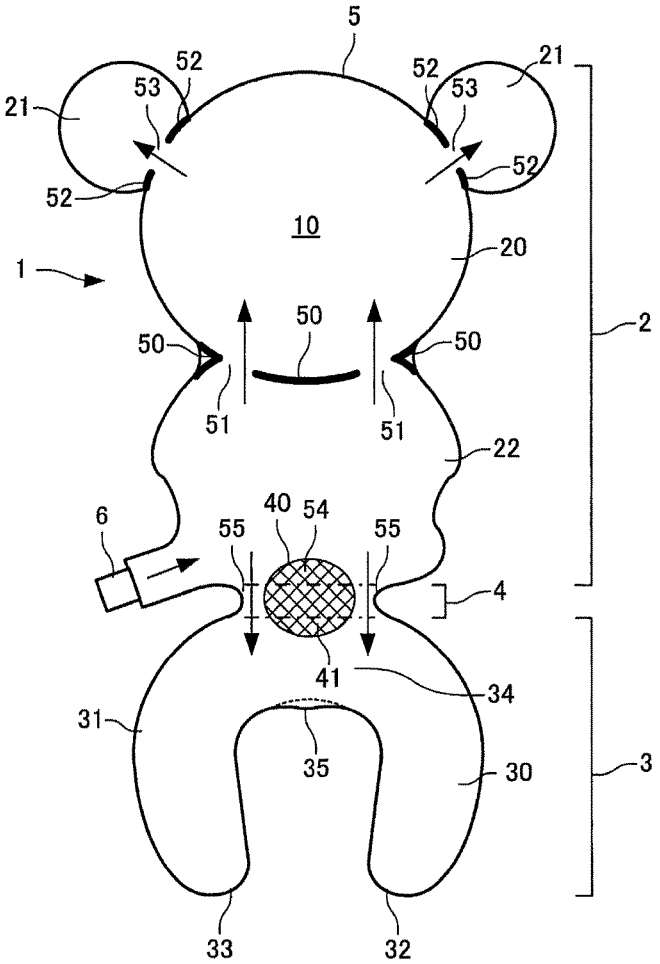
FIG. 1 is a front view illustrating a balloon according to the first embodiment.

Exemplary embodiments of the invention are described in detail below with reference to the drawings.

A balloon 1 according to one embodiment of the invention includes two plastic films 10 and 12 that are stacked and sealed at a peripheral edge 5, the balloon 1 including a first part 2, a second part 3, and a bending part 4 that is situated between the first part 2 and the second part 3, the bending part 4 including a gas passage 55 through which the interior of the first part 2 and the interior of the second part 3 communicate with each other, and a bending sealed part 54 that is formed by sealing the two plastic films 10 and 12 situated opposite to each other in an inward area relative to the peripheral edge 5, and an outer edge 40 of the bending sealed part 54 extending beyond the bending part 4 so as to be situated within the first part 2 and the second part 3.

1. First Embodiment

1.1. Balloon

Figure 2:
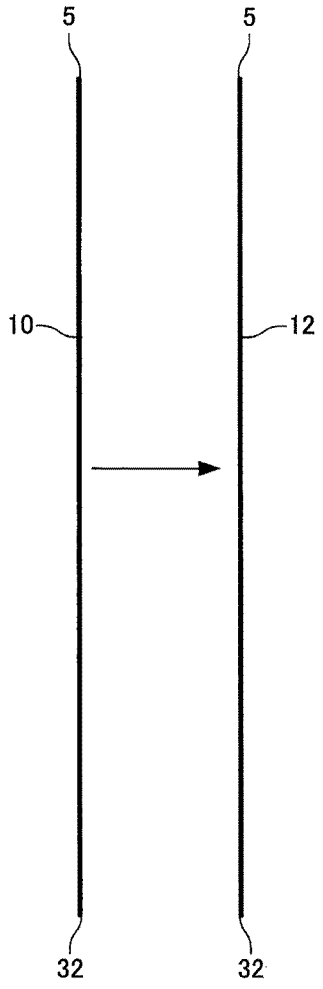
FIG. 2 is a side view illustrating a process for producing a balloon according to the first embodiment.

The configuration of a balloon 1 according to the first embodiment of the invention is described below with reference to FIGS. 1 and 2. FIG. 1 is a front view illustrating the balloon 1, and FIG. 2 is a side view illustrating a process for producing the balloon 1.

As illustrated in FIG. 1, the balloon 1 includes two plastic films 10 and 12 (first film 10 and second film 12) (see FIG. 2) that are stacked and sealed at the peripheral edge 5. Note that FIG. 1 is a front view illustrating the balloon 1 from the side of the first film 10 (i.e., plastic film), and the second film 12 is hidden behind the first film 10. The second film 12 that has the same shape as that of the first film 10 is provided opposite to the first film 10.

The balloon 1 includes the first part 2, the second part 3, and the bending part 4 that is situated between the first part 2 and the second part 3. The balloon 1 according to the first embodiment is a clinging doll-type balloon toy that is designed so that the first part 2 forms a doll body part that imitates a bear, and the second part 3 forms a clinging part that can cling to a human arm or the like. Note that the balloon 1 is not limited to a doll-type balloon toy, and the first part 2 need not necessarily imitate an animal (animal doll). The first part 2 may have a star-like shape, a heart-like shape, a circular shape, or the like, or may be designed to imitate a character (character doll) or the like. An advertisement or the like may be printed on the first part 2, for example.

The first part 2 includes a large circular head 20, circular ears 21 that are respectively provided on the right side and the left side of the head 20, a body 22 that is provided under the head 20 and formed so that the limbs protrude therefrom, and an air supply valve 6 that is provided to the body 22 at a position corresponding to the right foot.

The head 20 is connected to the ears 21 and the body 22 via a head sealed part 50 and an ear sealed part 52 (that are formed by welding part of the films situated opposite to each other), respectively. The head sealed part 50 and the ear sealed part 52 are formed along the circular contour of the head 20. A head gas passage 51 and an ear gas passage 53 (that are formed by not welding the films situated opposite to each other) are provided in an area in which the head 20 is connected to the ear 21 or the body 22. Therefore, the interior of the head 20 and the interior of the body 22 communicate with each other, and the interior of the head 20 and the interior of the ear 21 communicate with each other.

A detailed description of the structure of the air supply valve 6 is omitted. The air supply valve 6 has a known film valve structure provided with a check valve. The air supply valve 6 is provided so that the front end of the air supply valve 6 is inserted into the first part 2, and the base end of the air supply valve 6 protrudes from the first part 2. The air supply valve 6 need not necessarily be provided to the first part 2. When gas (e.g., air) is supplied to the interior of the first part 2, the gas is supplied to the entire balloon 1. After inflating the balloon 1, the air supply valve 6 may be removed so that only the part that functions as a check valve remains.

The second part 3 is a clinging part that has an inverted U shape and opens downward in a front view. The second part 3 includes two arms 30 and 31 that are situated at such an interval that the arms 30 and 31 can hold a human arm or the like, end parts 32 and 33 that are respectively provided at the front end of the arms 30 and 31, and a connection part 34 that connects the base ends of the arms 30 and 31.

The arms 30 and 31 slope inward from the connection part 34 to the end parts 32 and 33 so that the interval between the arms 30 and 31 slightly decreases.

The end parts 32 and 33 are designed to be positioned at a predetermined interval. The interval between the end parts 32 and 33 decreases when the balloon 1 is filled with a gas to such an extent that the end parts 32 and 33 do not come in contact with each other.

The connection part 34 has an approximately arcuate shape. The connection part 34 is connected to the bending part 4 at the upper part of the peripheral edge 5, and includes a protrusion 35 that is situated at the lower part of the peripheral edge 5 (i.e., the inner edge of the clinging part) and slightly protrudes downward. In FIG. 1, the broken line drawn above the protrusion 35 indicates a known inner edge shape.

The bending part 4 includes the gas passage 55 through which the interior of the first part 2 and the interior of the second part 3 communicate with each other, and the bending sealed part 54 that is formed by sealing the first film 10 and the second film 12 situated opposite to each other in an inward area relative to the peripheral edge 5. The bending part 4 bends when the balloon 1 is inflated so that the second part 3 is turned relative to the first part 2 to the first film 10 side or the second film 12 side.

The outer edge 40 of the bending sealed part 54 extends beyond the bending part 4 so as to be situated within the first part 2 and the second part 3. When the first part 2 and the second part 3 are filled with a gas (i.e., inflated), the first part 2 and the second part 3 are deformed so that the first part 2 and the second part 3 have an approximately circular cross-sectional shape. In this case, tension is applied to the bending sealed part 54 within the first part 2 and the second part 3 in the direction in which the first part 2 and the second part 3 move away from each other. The tension applied to the bending sealed part 54 causes the bending part 4 to bend so that the second part 3 is turned relative to the first part 2.

The outer edge 40 of the bending sealed part 54 is arched from the bending part 4 toward the first part 2 and the second part 3. In FIG. 1, the outer edge 40 is arched upward and downward to form an approximately elliptical shape. Note that the outer edge 40 can be arched in at least one of the first part 2 and the second part 3. For example, when the vertical dimension of the second part 3 is shorter than that of the first part 2 (see FIG. 1), tension is applied to the bending sealed part 54 to only a small extent within the second part 3 when the bending sealed part 54 is formed to be equally situated within the first part 2 and the second part 3. Therefore, only part of the outer edge 40 of the bending sealed part 54 that extends within the second part 3 may be arched. The bending sealed part 54 may be formed so that the outer edge 40 is situated up to a greater depth within the second part 3 as compared with the first part 2.

The bending sealed part 54 is preferably formed so that the bending sealed part 54 has the maximum depth within the first part 2 and the second part 3 in the vicinity of the center of the bending part 4 in the widthwise direction rather than in the vicinity of the peripheral edge 5. This is because tension is easily applied to the bending sealed part 54 in the vicinity of the center of the bending part 4 rather than in the vicinity of the peripheral edge 5.

Although an example in which one bending sealed part 54 is provided at the center of the bending part 4 in the widthwise direction has been described above, the configuration is not limited thereto. For example, a plurality of bending sealed parts 54 may be provided along the widthwise direction of the bending part 4. For example, a plurality of bending sealed parts 54 may be provided when producing a product in which the bending part 4 has a large width.

At least one pair of gas passages 55 are provided on either side of the bending sealed part 54 in the widthwise direction of the bending part 4. Specifically, the gas passage 55 is formed in each unwelded area of the bending part 4 that is situated between the peripheral edge 5 and the bending sealed part 54. The number of gas passages 55 provided to the bending part 4 is not limited to 2, but may be 3 or more.

1.2. Method for Producing Balloon

A method for producing the balloon 1 is described below with reference to FIG. 2.

As illustrated in FIG. 2, the first film 10 (plastic film) is stacked on the second film 12 (plastic film), and the first film 10 and the second film 12 are welded in a predetermined area (e.g., peripheral edge 5, head sealed part 50, ear sealed part 52, and bending sealed part 54 (see FIG. 1)).

A material used for producing a known synthetic resin balloon (e.g., polyethylene, polypropylene, polyester, polyamide, or vinyl chloride) can be properly used as the material for forming the first film 10 and the second film 12. The first film 10 and the second film 12 may be a film on which a metal (e.g., aluminum) is deposited, or may be a film formed using a resin (e.g., ethylene-vinyl alcohol copolymer) that exhibits an excellent gas barrier capability, or may be a laminate in which a plurality of sheets are stacked.

The first film 10 and the second film 12 can be welded using a known method (e.g., high-frequency welding, thermal welding, ultrasonic welding, or sealing and cutting). The first film 10 and the second film 12 are integrated by welding to provide seal-tightness.

The balloon 1 illustrated in FIG. 1 can be produced by thus sealing the first film 10 and the second film 12 by welding.

Note that the air supply valve 6 can be fitted to the first part 2 when sealing the first film 10 and the second film 12 at the peripheral edge 5.

1.3. Balloon in Inflated State

Figure 3A:
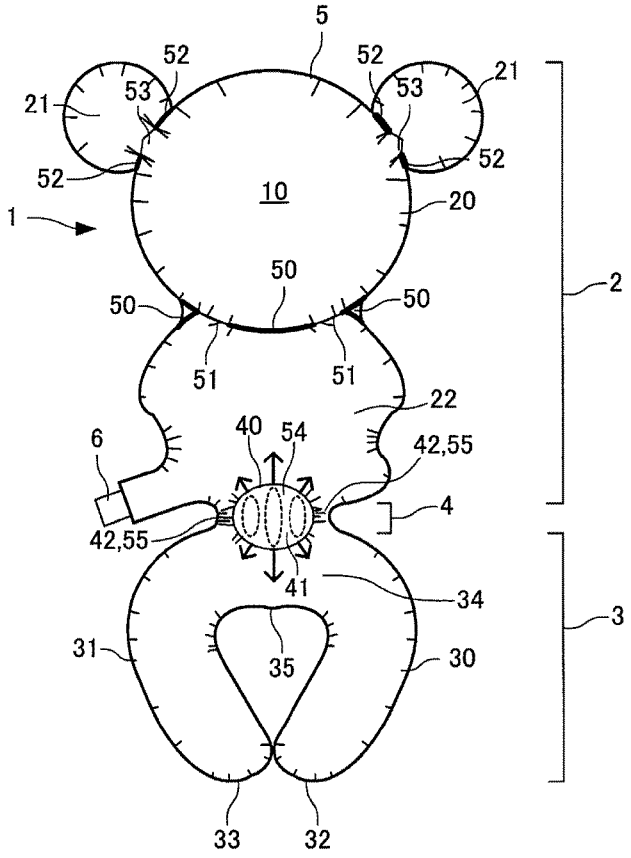
FIG. 3A is a front view illustrating a balloon in an inflated state according to the first embodiment.
Figure 3B:
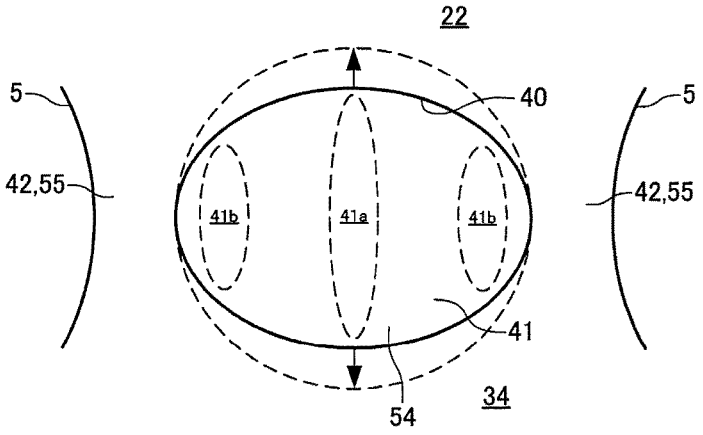
FIG. 3B is an enlarged view illustrating a bending part.

The balloon 1 in an inflated state is described below with reference to FIGS. 3A to 6. FIG. 3A is a front view illustrating the balloon 1 according to the first embodiment in an inflated state, and FIG. 3B is an enlarged view illustrating the bending part 4.

Figure 4A:
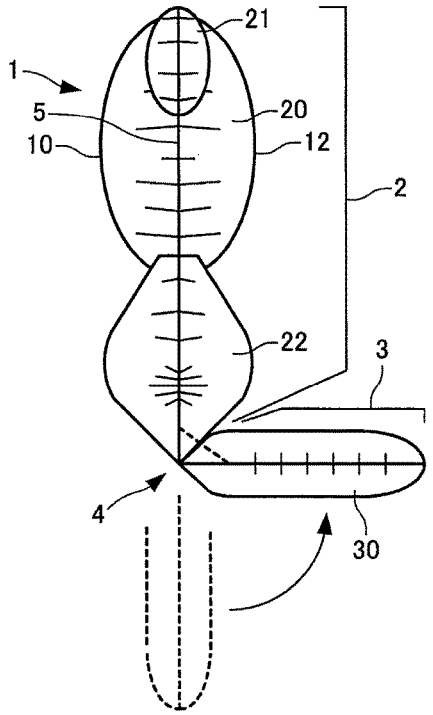
FIG. 4A is a side view illustrating a balloon in an inflated state according to the first embodiment.

As illustrated in FIG. 3A, the balloon 1 is inflated when a gas is injected into the balloon 1 through the air supply valve 6. As illustrated in FIGS. 4A and 5, the bending part 4 bends so that the second part 3 is turned backward or forward. Note that FIG. 3A illustrates a state in which the bending part 4 does not bend for convenience of explanation of a change in entire shape and the like.

The second part 3 is deformed when inflated so that the end part 32 of the arm 30 and the end part 33 of the arm 31 approach each other to form an approximately ring-like shape. When using the balloon 1, the end parts 32 and 33 are opened, and the arms 30 and 31 are caused to cling to (hold) the arm of the user, for example.

Since the connection part 34 includes the protrusion 35 that protrudes into the inner space defined by the approximately ring-like shape at a position opposite to the bending part 4, it is possible to prevent a situation in which wrinkles are formed in the vicinity of the center of the connection part 34 when the balloon 1 is inflated. Since the bending sealed part 54 is situated in the vicinity of the center of the connection part 34, the radius of a circle formed by the cross section decreases as compared with each side in the widthwise direction when the protrusion 35 is not provided, and wrinkles are formed in the connection part 34. Since the protrusion 35 can prevent a situation in which the radius of a circle formed by the cross section in the vicinity of the center of the connection part 34 decreases as compared with each side of the connection part 34 (i.e., wrinkles are rarely formed in the connection part 34), it is possible to provide a product that exhibits an excellent external appearance.

The bending sealed part 54 includes the outer edge 40, and a flat part 41 that is surrounded by the outer edge 40, the flat part 41 is formed by welding the first film 10 and the second film 12. The flat part 41 may be formed by welding the first film 10 and the second film 12 over the entire bending sealed part 54, or may be formed by welding the first film 10 and the second film 12 only in the vicinity of the outer edge 40. It is preferable to form the flat part 41 by welding the first film 10 and the second film 12 over the entire bending sealed part 54 so that the flat part 41 can withstand tension that is applied to the bending sealed part 54.

As illustrated in FIG. 3B, the body 22 and the connection part 34 that are contiguous to the bending part 4 are deformed when the balloon 1 is inflated, and the outer edge 40 of the bending sealed part 54 is to be deformed as indicated by the broken line.

Therefore, tension (that moves the first part 2 and the second part 3 away from each other) applied to the bending sealed part 54 increases in a center flat part 41*a* that is situated away from the peripheral edge 5 as compared with an edge flat part 41*b* that is situated close to the peripheral edge 5. It is considered that the second part 3 is turned relative to the first part 2 due to the difference in tension between the center and each side of the bending sealed part 54.

The gas passage 55 is expanded on each side of the bending sealed part 54 in the widthwise direction to form a pillar 42. The pillar 42 bends together with the bending part 4 while allowing gas to pass through.

Figure 4B:
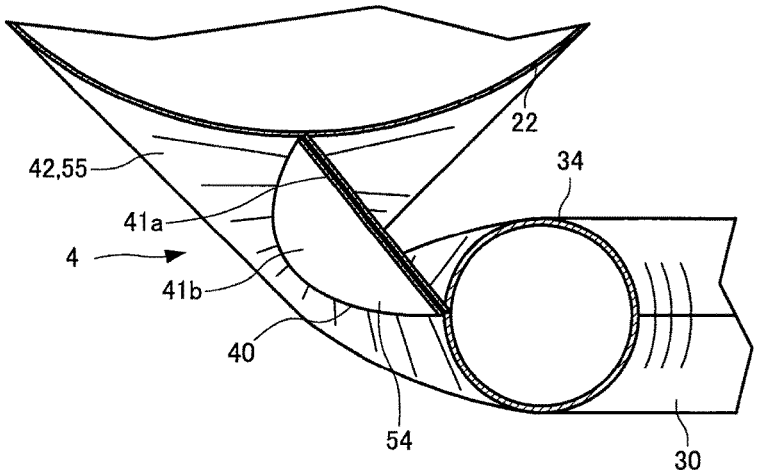
FIG. 4B is an enlarged vertical cross-sectional view illustrating a bending part, taken along the line IV-IV in FIG. 5.

The balloon 1 in a bent state is described below with reference to FIGS. 4A to 6. FIG. 4A is a side view illustrating the balloon 1 in an inflated state, and FIG. 4B is an enlarged cross-sectional view illustrating the bending part 4 taken along the line IV-IV illustrated in FIG. 5. FIG. 5 is a front view illustrating the balloon 1 in an inflated state in which the second part 3 is turned backward. FIG. 6 is a view of the balloon 1 from an oblique lower-right front side.

As illustrated in FIG. 4A, the second part 3 is turned to the right (i.e., the side where the second film 12 is situated) around the bending part 4, and forms approximately a right angle with the first part 2.

As illustrated in FIG. 4B, the bending sealed part 54 provided to the bending part 4 is pulled between the body 22 and the connection part 34, and deformed (i.e., the pillar 42 is bent) so that the body 22 and the connection part 34 approach each other on the right side in FIG. 4B.

Tension is always applied to the bending sealed part 54 in the direction in which the second part 3 approaches the first part 2, and causes the second part 3 to be turned at approximately a right angle when the second part 3 has moved away from the first part 2. Therefore, it is unnecessary to provide a bent state-holding member (double-sided pressure-sensitive adhesive tape) such as that disclosed in Patent Literature 1 that maintains the balloon in a bent state. Note that a bent state-holding member such as that disclosed in Patent Literature 1 may be used as an auxiliary member when it is desired to necessarily maintain the balloon in a bent state.

As illustrated in FIG. 5, small wrinkles are formed in the vicinity of the center of the connection part 34 in the widthwise direction. However, the size of the wrinkles is reduced due to the effect of the protrusion 35 described above with reference to FIG. 3A and FIG. 3B, and the external appearance of the balloon 1 is affected to only a small extent.

The balloon 1 was produced, and inflated (see FIG. 6). When the balloon 1 was filled with air, the bending part 4 bent spontaneously, and the bent state was maintained as long as an external force was not applied. When an external force was applied to the balloon 1 so as to move the second part 3 away from the first part 2 (i.e., unbend the balloon 1 as illustrated in FIG. 3A), and then removed, the bending part 4 bent spontaneously, and the bent state was recovered.

As described above, the balloon 1 that is produced by sealing two plastic films (plastic films 10 and 12) can maintain a bent state in a state in which the balloon is filled with a gas. Note that the expression "maintain a bent state" used herein means that the balloon 1 maintains a bent state as long as an external force is not applied to the balloon 1 (i.e., maintains a bent state independently of the weight of the balloon 1).

2. Comparative Example 1

Figure 7:
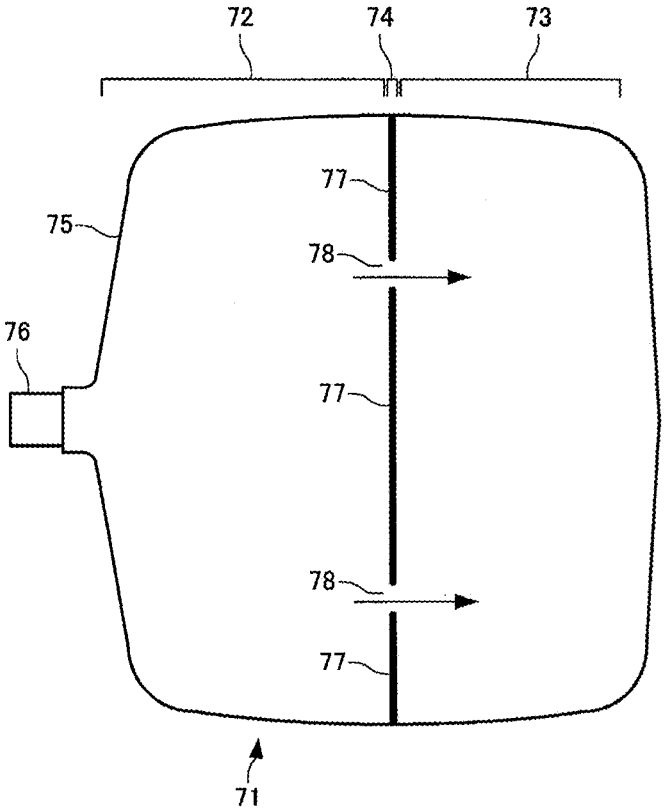
FIG. 7 is a front view illustrating a balloon in Comparative Example 1.
Figure 8:
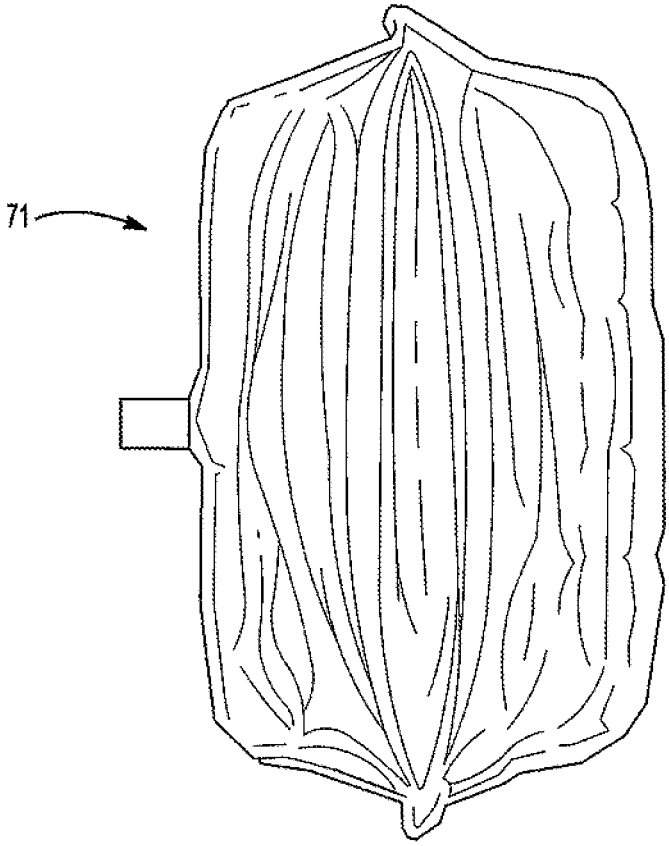
FIG. 8 is a view of a balloon in Comparative Example 1 from the front side.

A balloon 71 of Comparative Example 1 that differs from the balloon 1 as to the configuration of the bending part is described below with reference to FIGS. 7 and 8. FIG. 7 is a front view illustrating the balloon 71 of Comparative Example 1, and FIG. 8 is a view of the balloon 71 of Comparative Example 1 from the front side.

As illustrated in FIG. 7, the balloon 71 is produced by sealing two plastic films at a peripheral edge 75. The balloon 71 includes a first part 72, a second part 73, and a bending part 74, the first part 72 and the second part 73 being situated on either side of the bending part 74. The balloon 71 of Comparative Example 1 has an approximately rectangular (quadrangular) external shape when viewed from the front side, and the bending part 74 is formed to extend in the vicinity of the center of the balloon 71.

The bending part 74 includes a sealed part 77 that is linearly and narrowly formed by welding so as to have a small width. The sealed part 77 is disconnected in two areas, in which a gas passage 78 is formed.

When air is injected into the balloon 71 through an air supply valve 76 that is provided to protrude from the vicinity of the center of one side of the balloon 71, the air flows into the second part 73 from the first part 72 through the gas passages 78 (i.e., the entire balloon 71 is inflated).

As illustrated in FIG. 8 (that illustrates the balloon 71 of Comparative Example 1 in an inflated state), the bending part 74 did not bend spontaneously. When the bending part 74 of the balloon 71 in an inflated state was bent, the state illustrated in FIG. 8 was recovered (i.e., the balloon 71 could not maintain the bent state).

A balloon in which the width (i.e., the dimension in the rightward-leftward direction in FIG. 7) of the sealed part 77 was increased to have a rectangular shape, and the gas passage 78 was provided on each end of the sealed part 77 was also produced. However, the resulting balloon could not maintain the bent state.

3. Second Embodiment

Figure 9:
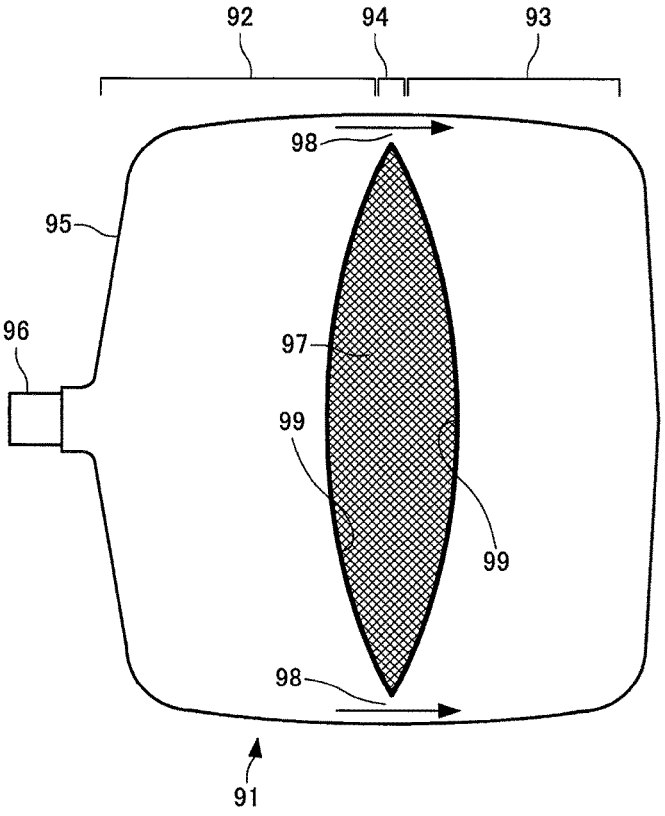
FIG. 9 is a front view illustrating a balloon according to the second embodiment.
Figure 10:
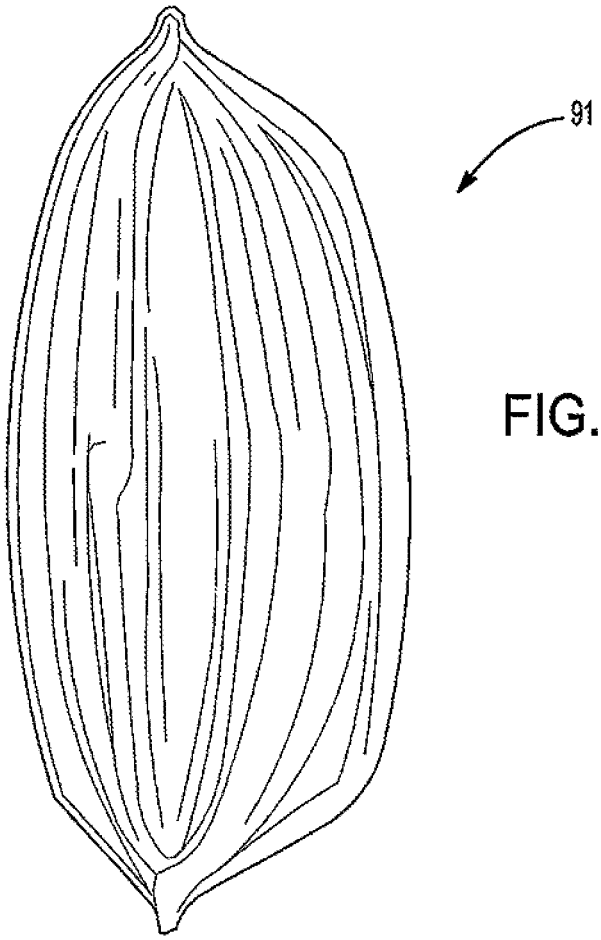
FIG. 10 is a view of a balloon according to the second embodiment from the front side.

A balloon 91 according to the second embodiment of the invention that differs from the balloon 71 as to the configuration of the bending part is described below with reference to FIGS. 9 and 10. FIG. 9 is a front view illustrating the balloon 91, and FIG. 10 is a view of the balloon 91 from the front side.

As illustrated in FIG. 9, the balloon 91 is basically the same as the balloon 71 of Comparative Example 1, except for the configuration of a bending part 94. Note that description of the same features as those described above in connection with Comparative Example 1 is omitted.

The bending part 94 includes a bending sealed part 97 that has an outer edge 99 that has a large depth within a first part 92 and a second part 93 in the vicinity of the center thereof, and decreases in width toward an peripheral edge 95. The bending sealed part 97 is formed by welding two plastic films.

A gas passage 98 is formed between the bending sealed part 97 and the peripheral edge 95.

When air is injected into the balloon 91 through an air supply valve 96 that is provided to the balloon 91, the entire balloon 91 is inflated.

As illustrated in FIG. 10 (that illustrates the balloon 91 in an inflated state), the balloon 91 (bending part 94) bent spontaneously, and could maintain the bent state. When the bending part 94 of the balloon 91 in an inflated state was unbent, and released, the state illustrated in FIG. 10 was immediately recovered.

As illustrated in FIG. 10, the bending sealed part 97 is tense in the vicinity of the center of the bending part 94 (i.e., high tension is applied), and wrinkles are formed as the distance from the peripheral edge 95 decreases (i.e., low tension is applied).

4. Comparative Example 2

A balloon 91*a* of Comparative Example 2 that differs from the balloon 91 according to the second embodiment in that the area of the bending sealed part 97 surrounded by the outer edge 99 was removed is described below. FIG. 11 is a view of the balloon 91*a* of Comparative Example 2 from the front side.

Since a through-hole is formed in the area surrounded by the outer edge 99, the balloon 91*a* does not include the bending sealed part 97.

As illustrated in FIG. 11, the bending part of the balloon 91*a* bent due to the weight of the balloon 91*a*. However, when the balloon 91*a* was raised and turned over, the bending part bent in the opposite direction due to the weight of the balloon 91*a* (i.e., the balloon 91*a* could not maintain the bent state).

A balloon was produced in the same manner as the balloon 91, except that a plurality of (nine) circular sealed parts (having an identical size) were provided through (eight) gas passages instead of the bending sealed part 97. The resulting balloon could maintain a bent state in the same manner as the balloon 91 (see FIG. 10).

5. Third Embodiment

Figure 13:
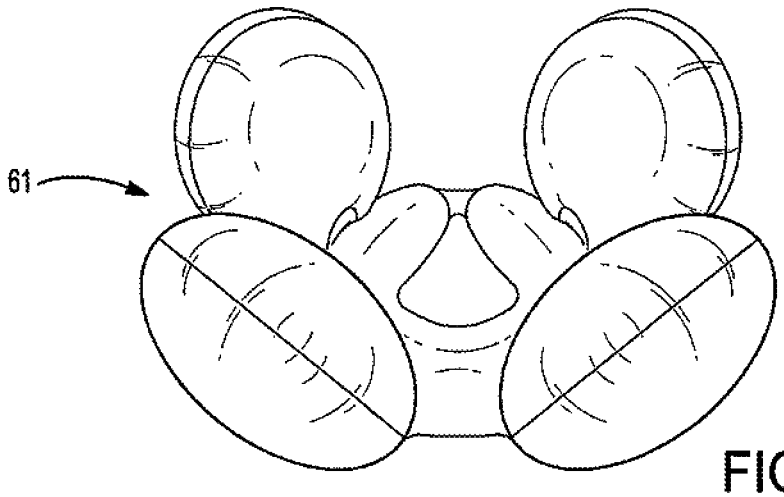
FIG. 13 is a view of a balloon according to the third embodiment from an oblique upper rear side.
Figure 14:
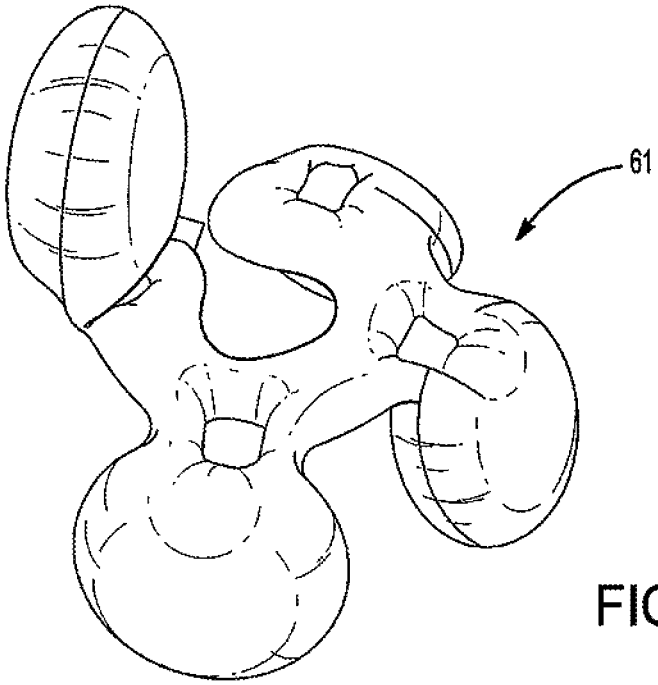
FIG. 14 is a view of a balloon according to the third embodiment from an oblique upper-left rear side.

A balloon 61 according to the third embodiment of the invention that includes a plurality of first parts 62 is described below with reference to FIGS. 12 to 14. FIG. 12 is a front view illustrating the balloon 61, FIG. 13 is a view of the balloon 61 according to the third embodiment from an oblique upper rear side, and FIG. 14 is a view of the balloon 61 according to the third embodiment from an oblique upper-left rear side.

As illustrated in FIG. 12, the balloon 61 includes a plurality of (four) first parts 62 and one second part 63. The second part 63 is a clinging part having an inverted U shape.

A bending part 64 is provided between each of the four first parts 62 and the second part 63, and a bending sealed part 67 is formed in each bending part 4. The bending sealed part 67 is formed by welding two plastic films at a peripheral edge 65 (see the first embodiment).

The bending part 64 includes gas passages 68 that are provided on either side of the bending sealed part 67. When air is injected into the balloon 61 through an air supply valve 66, the air flows into the first parts 62 and the second part 63 through the gas passages 68 (i.e., the balloon 61 is inflated).

The structure of the bending sealed part 67 is the same as that described above in connection with the first embodiment. The outer edge of the bending sealed part 67 extends beyond the bending part 64 so as to be situated within the first part 62 and the second part 63.

Therefore, when the balloon 61 is inflated, each bending part 64 bends spontaneously, and the four (circular) first parts 62 are turned relative to the second part 63 (see FIG. 13). The direction in which each first part 62 is turned can be set independently. For example, only one first part 62 can be turned in a different direction (see FIG. 14).

The second part 63 may be a clinging part that includes end parts 69 and has an approximately ring-like shape. The second part 63 can be fitted to a human arm or the like.

The balloon 61 could maintain the state in which the first parts 62 were turned relative to the second part 63.

The invention is not limited to the above embodiments. The invention includes various modifications and design variations that can be implemented without departing from the scope of the invention.

The invention claimed is:

1. A toy balloon comprising two plastic films that are stacked and sealed at a peripheral edge, the toy balloon including a first part, a second part, and a bending part that is situated between the first part and the second part, the bending part including a gas passage through which an interior of the first part and an interior of the second part communicate with each other, and a bending sealed part that is formed by sealing the two plastic films situated opposite to each other in an inward area relative to the peripheral edge, an outer edge of the bending sealed part extending beyond the bending part so as to be situated within the first part and the second part, and no through-hole being formed inside the outer edge, and the bending part bending due to tension applied to the bending sealed part by filing the toy balloon with a gas and inflating the toy balloon so that the second part is spontaneously turned relative to the first part and a bent state of the toy balloon is maintained.

2. The balloon as defined in claim 1, wherein the outer edge of the bending sealed part is arched from the bending part toward at least one of the first part and the second part.

3. The balloon as defined in claim 1, wherein at least one pair of the gas passages are provided on either side of the bending sealed part in a widthwise direction of the bending part.

4. The balloon as defined in claim 1, wherein a plurality of the bending sealed parts are formed along a widthwise direction of the bending part.

5. The balloon as defined in claim 1, wherein a clinging part includes two arms, end parts of the two arms, and a connection part that connects base ends of the two arms, and forms an approximate ring shape when the balloon is filled with a gas and inflated, and the connection part includes a protrusion that protrudes into an inner space defined by the approximate ring shape at a position opposite to the bending part.

6. The balloon as defined in claim 2, wherein at least one pair of the gas passages are provided on either side of the bending sealed part in a widthwise direction of the bending part.

7. The balloon as defined in claim 2, wherein a plurality of the bending sealed parts are formed along a widthwise direction of the bending part.

8. The balloon as defined in claim 3, wherein a plurality of the bending sealed parts are formed along a widthwise direction of the bending part.

9. The balloon as defined in claim 8, wherein a plurality of the bending sealed parts are formed along a widthwise direction of the bending part.

10. A toy balloon comprising two plastic films that are stacked and sealed at a peripheral edge, the toy balloon including a first part, a second part, and a bending part that is situated between the first part and the second part, the bending part including a gas passage through which an interior of the first part and an interior of the second part communicate with each other, and a bending sealed part that is formed by sealing the two plastic films situated opposite to each other in an inward area relative to the peripheral edge, and an outer edge of the bending sealed part extending beyond the bending part so as to be situated within the first part and the second part, an entire inner surface of the outer edge being sealed, the bending part bending due to tension applied to the bending sealed part by filling the toy balloon with a gas and inflating the toy balloon so that the second part is spontaneously turned relative to the first part and a bent state of the toy balloon is maintained.

11. A toy balloon comprising two plastic films that are stacked and sealed at a peripheral edge, the toy balloon including a first part, a second part, and a bending part that is situated between the first part and the second part, the bending part including a gas passage through which an interior of the first part and an interior of the second part communicate with each other, and a bending sealed part that is formed by sealing the two plastic films situated opposite to each other in an inward area relative to the peripheral edge, and an outer edge of the bending sealed part extending beyond the bending part so as to be situated within the first part and the second part, no through-hole being formed inside the outer edge, the bending part bending due to tension applied to the bending sealed part by filling the toy balloon with a gas and inflating the toy balloon so that the second part is turned at approximately a right angle relative to the first part and a bent state of the toy balloon is maintained.

* * * * *